US007048403B2

(12) United States Patent
Parker et al.

(10) Patent No.: US 7,048,403 B2
(45) Date of Patent: May 23, 2006

(54) LIGHT WITH A CLIP

(75) Inventors: David H. Parker, Torrance, CA (US); Kevin Deighton, Long Beach, CA (US); Mac Kidakarn, Lawndale, CA (US)

(73) Assignee: Pelican Products, Inc., Torrance, CA (US)

( * ) Notice: Subject to any disclaimer, the term of this patent is extended or adjusted under 35 U.S.C. 154(b) by 84 days.

(21) Appl. No.: 10/733,880

(22) Filed: Dec. 10, 2003

(65) Prior Publication Data

US 2005/0128738 A1 Jun. 16, 2005

(51) Int. Cl.
*F21V 21/08* (2006.01)

(52) U.S. Cl. ..... 362/103; 362/365; 362/105; 362/155; 362/188; 362/200; 362/295

(58) Field of Classification Search ..... 362/103, 362/105, 155, 188, 191, 200, 295, 365
See application file for complete search history.

(56) References Cited

U.S. PATENT DOCUMENTS 5,183,324 A * 2/1993 Thomas ..... 362/103
D350,618 S 9/1994 Parker
5,410,457 A 4/1995 Parker
D383,558 S 9/1997 Parker
5,752,293 A * 5/1998 Lowry et al. ..... 16/342
5,871,272 A 2/1999 Sharrah et al.
5,904,414 A * 5/1999 Monteleone et al. ..... 362/205
6,320,641 B1 * 11/2001 Bauer et al. ..... 365/18
6,523,972 B1 2/2003 Sharrah et al.
2003/0112624 A1 6/2003 Quitner

* cited by examiner

*Primary Examiner*—Sandra O'Shea
*Assistant Examiner*—Mark Tsidulko
(74) *Attorney, Agent, or Firm*—Greenberg Traurig, LLP

(57) ABSTRACT

A portable light intended for mounting on a garment as support includes two LED light sources spaced apart towards the rear of the portable light. A clipped base below on anchor facilitates locating a garment between the anchor and the base, and a spring action urges the base toward the anchor. A hingedly movable head for the LEDs is mounted on the housing to move to and form the housing. An opening of the housing causes a switch in the housing to move between an opened and closed position such that a circuit actives or de activates the LED lights when the head opens or closes relative to the housing.

15 Claims, 5 Drawing Sheets

LIGHT WITH A CLIP

BACKGROUND

This invention relates to a portable light. In particular, it is concerned with a light which can be supported on a garment such as a cap, shirt, or jacket. In other instances, the light can be supported on a book, writing tablet, belt or the like.

Use of flashlights for mounting on clothing is known. This assists workers and security personnel in freeing the worker's hands so that other activities can be engaged in, while the light can be made to shine on a desired object.

The present invention is directed to an improved structure for mounting such a portable light on the garments or other paraphernalia associated with a person who needs to keep at least one hand, and preferably both hands, free for other activities.

The invention seeks to improve the known pocket lights and other techniques for mounting a flashlight in this manner.

SUMMARY

A portable flashlight includes a clip which has a base which is hingedly mounted with an anchor. A spring urges the base and the anchor together, and between the base and the anchor there can be located a support such as a garment or other paraphernalia associated with a user. The anchor and the base are engaged in the spring action by the clip effect so that the portable light can be securely mounted on the support which can be a user's garment.

On top of or as part of the anchor, there is a housing member, which mounts a movable, preferably, pivotally mounted head in which two LEDs are located. Movement of the head causes a protrusion on the head to move to a position different from a position when the head is closed on the support. The housing may be part of an overall housing for a combined anchor-housing structure.

When the head moves to the different position, it causes the protrusion to move relative to a circuit board in the housing and a circuit closes to activate the LEDs. This is effected by closing the circuit between batteries and the circuit board which are both located in the shell or casing formed the housing and the anchor.

The LEDs are mounted in the head which is located towards the rear of the portable light. A friction forming o-ring in the hinge which mounts the head with the housing acts to prevent the inadvertent closure or opening of the head relative to the housing. Accordingly, opening of the head on the housing causes the light to distend upwardly from the front face of the housing.

The light is further described with reference to the accompanied drawings and description.

DETAILED DESCRIPTION

Features of an embodiment are now discussed from an illustrative perspective.

A portable light for mounting on a support comprises an anchor to be secured with a support. There is a housing portion mounted to the anchor, and the housing portion includes a head for the light source. A switch for the light source is operable by movement of the head for the light source relative to the housing. The head is hingedly movable relative to the housing, and the switch is operable to turn the light source on when the head is moved from the housing.

The anchor cooperates with a base plate and the light and is mounted on the anchor on a position opposite to the base. The base and the anchor are hingedly connected, and a spring urges the base plate and the anchor towards each other.

The base and the anchor effectively form a clip for securing the light to a support. As such that the material for the support is locatable between the base and the anchor, and thereby the light is secured to the support for the light.

The head includes at least two light sources. The light sources are angled relative to the head to the extend a field of illumination forwardly from the rear of the head toward the forward end of the head. The field of illumination partly overlaps in the area at the forward end of the housing. The two light sources are spaced apart at a position remote from the forward end of the housing and the rear end of the housing.

The head includes a protrusion for extending through an aperture in a top face the housing. The protrusion acts to operate a switch when the protrusion moves between a position relative to the housing thereby to activate a switch between closure and opening. The protrusion is relatively fixed on an under plate of the head. The activation of the switch is effected by the location of the head relative to the position of the housing.

The housing and anchor are fixedly formed relative to each other. There is a friction element in a hinge between the head and the housing, thereby to inhibit movement between the head and housing.

Figure 1:
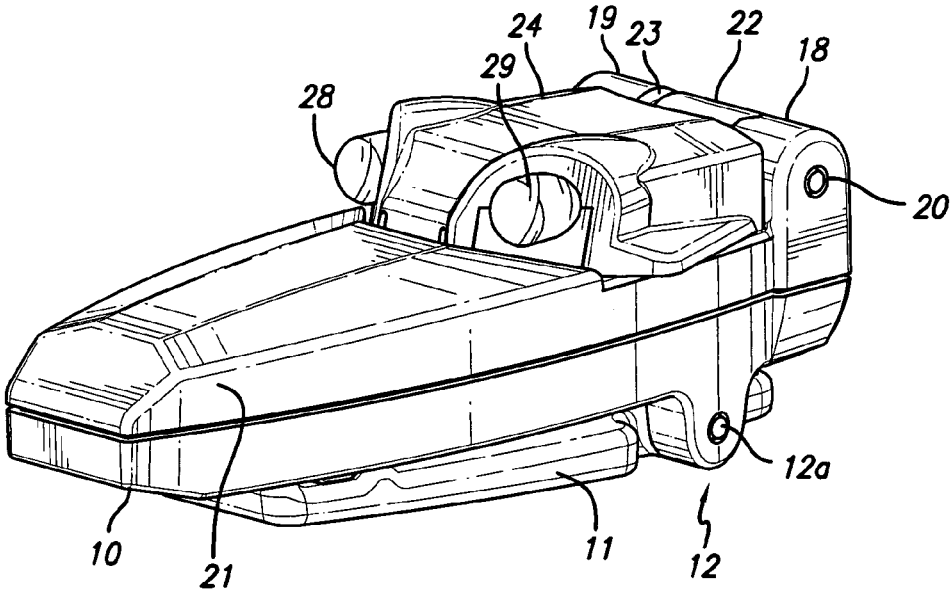
FIG. 1 is a perspective view viewed from the front of the portable light.

FIG. 1 shows an anchor, in the form of a plate or housing 10, which has mounted on one side a base element or plate 11. A spring hinge pivoting connection 12 is formed so that between the anchor 10, base plate 11 and the pivot rod 12, there is a biasing force to cause the anchor and base to be urged together to form a clip.

Movement of the tail, handle or finger grip 13 which extends from the base plate 11 about the pivot rod 12*a* causes the front portion 14 of the base plate 11 to open. There is a leaf spring 12*b* which is mounted at the area of the hinge 12 so that it applies the spring action on the hinge 12. The hinge area has two downwardly directed pillars between which there is mounted a central portion of the base plate 11 in the spring-hinge relationship.

A garment or other paraphernalia of the user can enter through the mouth area 15 between the underside 16 of the anchor 10 and the top of the base element or plate 11. The garment or other support will be located in the area 17 of the portable flashlight.

The anchor plate or housing 10 at its rear section has two upstanding pillars 18 and 19. These form a second hinge about a pivot point or rod 20.

A housing 21 is mounted on or with the anchor 10, and there is also a slot 21*a* which extends between the anchor 10 and the support. The anchor 10 and the housing 21 are formed as a shell or casing.

Between the upstanding portions 18 and 19 there is a cylindrical sleeve 22 which is located for pivotal movement about the pivot or rod 20. There is also a rubber o-ring 23 which is located around the axle rod 20. This provides a friction effect so that the sleeve 22 is inhibited from unintentional movement about the axle rod 20. The sleeve 22 is formed to extend from the rear portion of a head member 24. The head member 24 also includes a bottom surface 25.

On either side of the head 24 there are two tabs 24*a* and 24*b*. These tabs facilitate the opening and the closing of the head 24 and adjacency with the top of the mating portion of the housing 21. The head 24 is mounted on a top of the housing, and the top is on the side remote from the anchor. The head has a small protrusion 24*c* which clips into engagement in an indent 24*d* formed on a step wall formation adjacent to a top face of the housing 21. This ensures a positive locking engagement when the head 24 is in a closed position on the housing 21.

At the forward end of the head member 24 there are two apertures 26 and 27 for accommodating two LEDs 28 and 29 respectively. The LEDs 28 and 29 are mounted on a plate 30 which in turn is connected to a circuit board 31 through appropriate connected through wiring 32. There is a switch activating protrusion 33 from the bottom surface 25 of the head 24. The protrusion 33 is fixed and is moveable as the head 24 moves so that it can have different positions to activate a switch related to the circuit board 31. As such in the closed position the protrusion is accommodated in an aperture 34 which leads to one side of the circuit board 31. The circuit board 31 is mounted in the support housing 21 in a cavity formed by the outer shell of the housing 21, which mounts the head 24. Movement of the protrusion 33 acts to close a circuit and open a circuit as necessary.

The anchor 10 provides a housing for batteries 36 and 37 which are connected through a spring conductor 38 mounted in the base of the anchor 10. When the housing and the anchor are closed together with the batteries in position the circuit is essentially made. The protrusion 33 operates through the aperture 34 packs to open a close this up at so as to power and keep our the LEDs in the head formation 24. The circuit board 31 is suitably and fixed to the top of the shell forming the housing 21. The wires 32 runs from underneath the shell through the portion adjacent the cylindrical sleeve 22 and into the head member 24 to connect with the LEDs 28 and 29.

Many other forms of the invention exist, each differing from the other in matters of detail only. For instance instead of a two part housing and anchor there can be more components or even a single component. Different kind of clip formations can be provided. There may not be a spring mechanism associated with the clip.

Instead of two LEDs there may more or less and instead of the LEDs there can be other light sources. The system can be used for different lighting needs, even without the mounting clip.

There can be other securing techniques for permitting the light to be affixed to a support. The base can be made of an inherently spring like type material with a bias towards the bottom of the anchor. Other structure can be used to permit the securing of the light to the support. For instance a clip like structure similar to a gem clip can be used. The anchor and support can be formed as a different form. It can be an integral unit in which the batteries and circuit are mounted.

Figure 2:
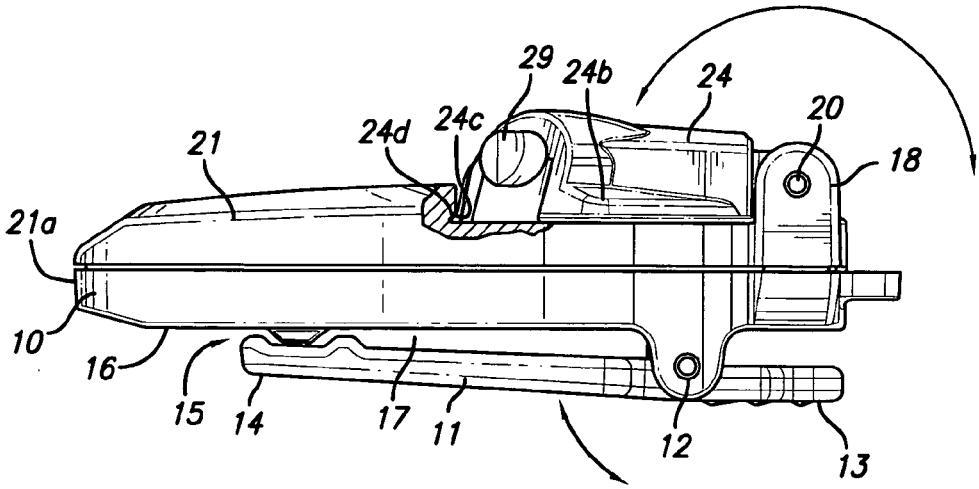
FIG. 2 is a side view of the portable light.
Figure 3:
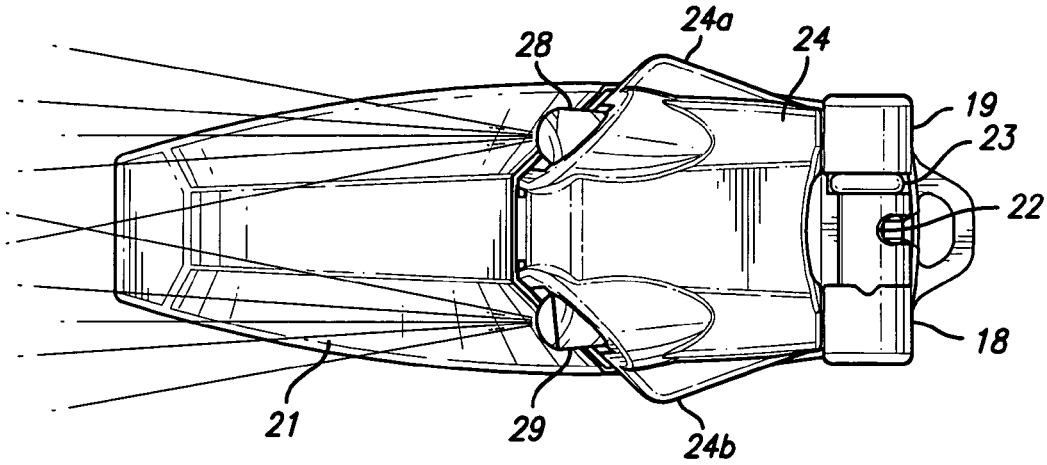
FIG. 3 is a top view of the portable light.
Figure 4:
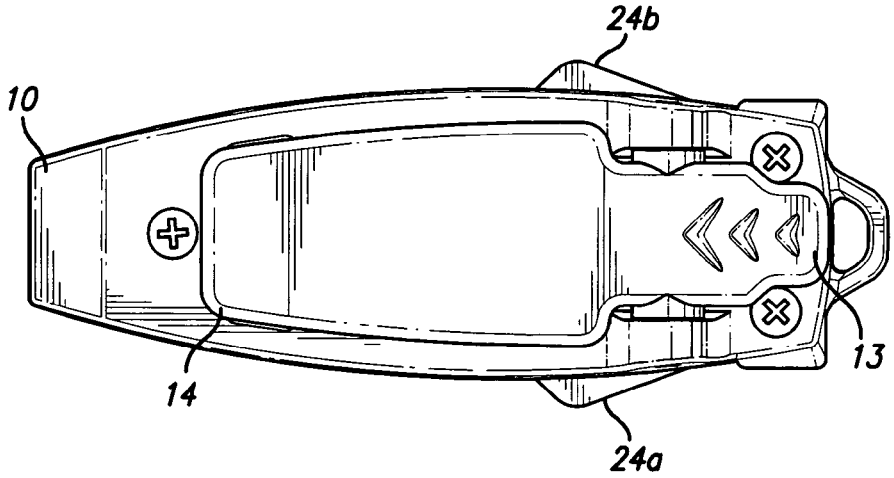
FIG. 4 is an under view of the portable light.
Figure 5:
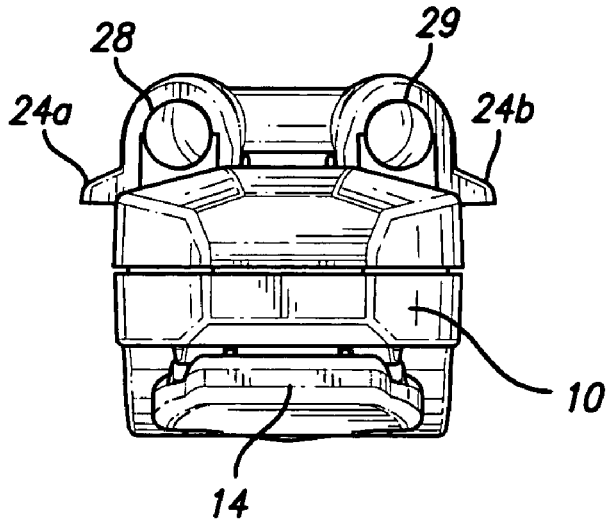
FIG. 5 is a front view of the portable light.
Figure 6:
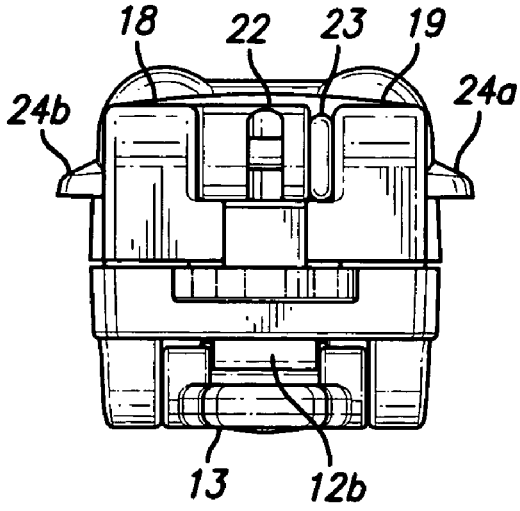
FIG. 6 is a rear view of the portable light.
Figure 7:
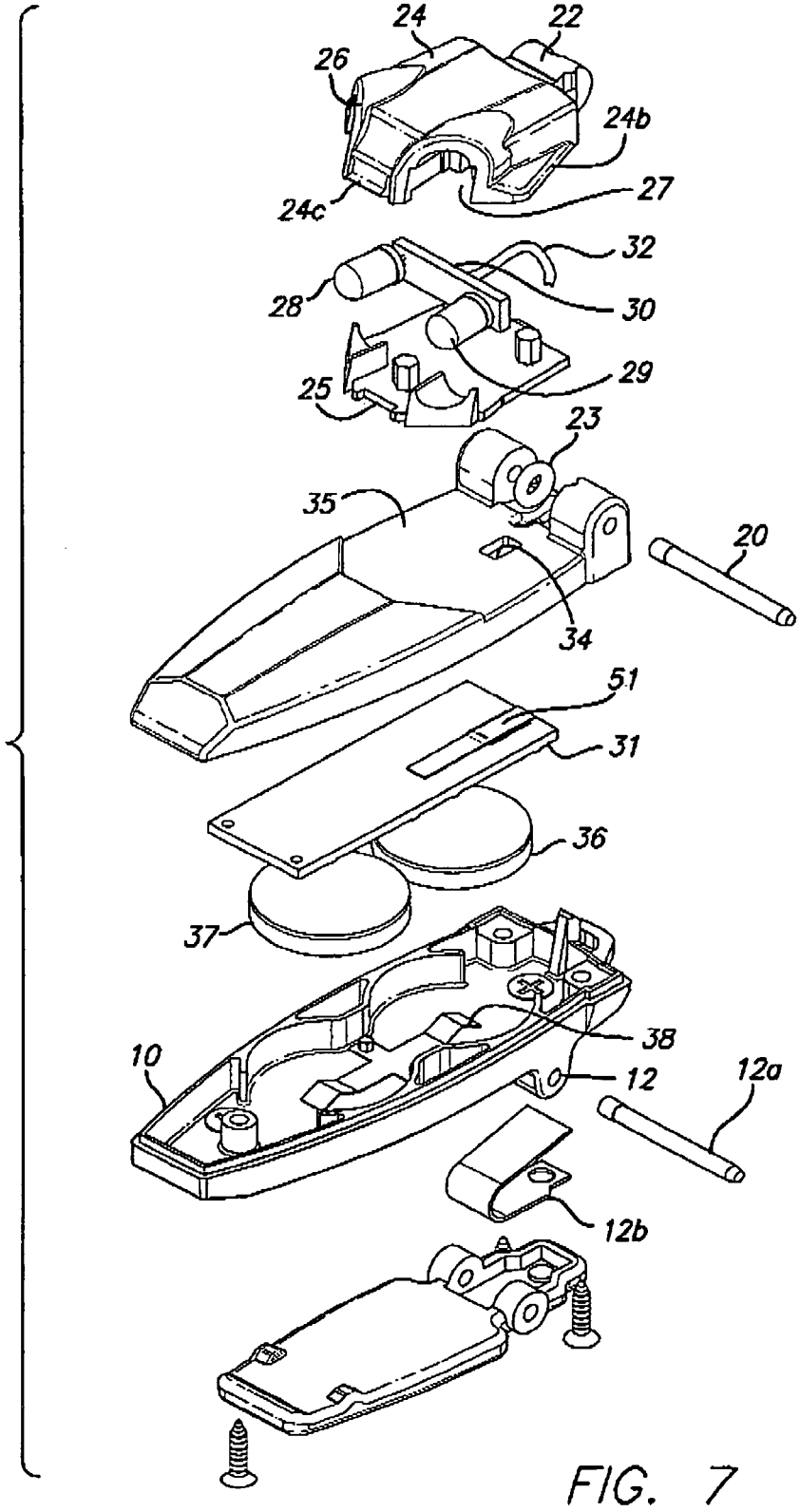
FIG. 7 is an exploded view of the portable light showing the base plate, anchor plate, and hinge member with the head above the hinge member.
Figure 8:
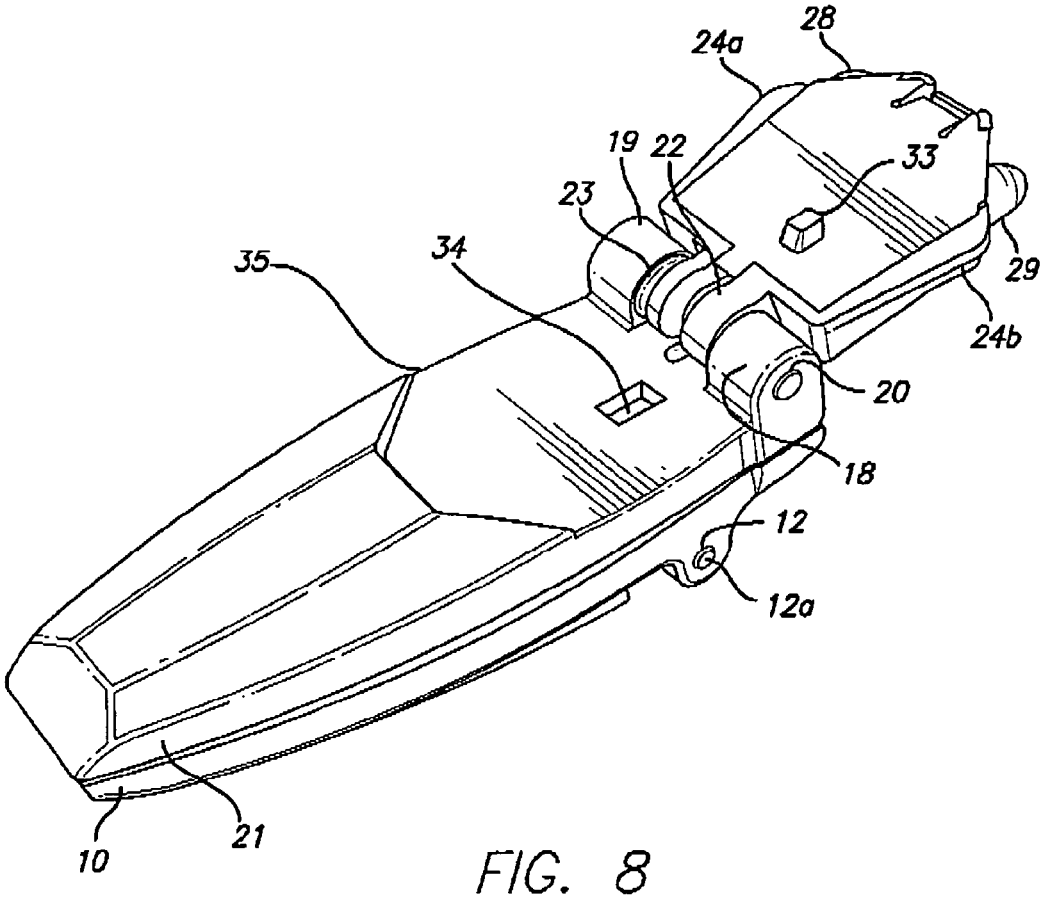
FIG. 8 is a view of the portable light with the head pivotably moved relative to the hinge member.

It is to be understood that aspects of this invention could be used in other applications, such as for use where an artisan needs hands free to work a tool. The light can also be clipped in positions to aim at different targets while a persons hands are free for other functions. The angle of the light can change as necessary by opening the head to any desired degree. Arrows shown on FIG. 2 illustrate the movement possibilities of the head and the base. In some cases the clip may be dispensed with a releasable adhesive element employed on the anchor face for securing to a support. The head can be moved between a closed position and about 180 degrees opposite to the closed position.

The invention should be determined by the following claims.

We claim:

1. A portable light for mounting on a support comprising:

an anchor to be secured with a support;

a housing portion mounted to the anchor, the housing portion including a head for a light source;

a switch for the light source, the switch being operable by movement of the head for the light source relative to the housing; and a base plate cooperating with the anchor, the light source being mounted relative to the anchor on a position opposite to the base plate.

2. A light as claimed in claim 1, wherein the base plate and the anchor are hingedly connected.

3. A light as claimed in claim 1, wherein the base plate and the anchor are hingedly connected, and a spring urging the base plate and the anchor towards each other.

4. A light as claimed in claim 3, wherein the base and the anchor effectively form a clip for securing the light to a support, such that the material for the support is locatable between the base and the anchor, and thereby the light is secured to the support for the light.

5. A light as claimed in claim 1, wherein the head is hingedly movable relative to the housing, and wherein the switch is operable to turn the light source on when the head is moved from the housing.

6. A light as claimed in claim 1, wherein the head includes at least two light sources, the light sources being angled relative to the head to extend a field of illumination forwardly from the rear of the head toward the forward end of the head, and wherein the field of illumination partly overlaps in the area at the forward end of the housing.

7. A light as claimed in claim 6, wherein the two light sources are spaced apart at a position remote from the forward end of the housing and the rear end of the housing.

8. A light as claimed in claim 1, wherein the head is mounted on a top of the housing, the top being on the side remote from the anchor, and the head being for clipping engagement into an indent formed on a top face of the housing.

9. A light as claimed in claim 8, wherein the head includes a protrusion, the protrusion being for extending through an aperture in a top face the housing, the protrusion acting to operate a switch when the protrusion moves between a position relative to the housing thereby to activate a switch between closure and opening.

10. A light as claimed in claim 9, wherein the protrusion is relatively fixed on an under plate of the head, and the activation of the switch being effected by the location of the head relative to the position of the housing.

11. A light as claimed in claim 10, wherein the housing and anchor are fixedly formed relative to each other.

12. A light as claimed in claim 11, including a friction element in a hinge between the head and the housing, thereby to inhibit movement between the head and housing.

13. A portable light for mounting on a support comprising:

an anchor to be secured with a support;

a housing portion mounted to the anchor, the housing portion including a head for a light source;

a switch for the light source, the switch being operable by movement of the head for the light source relative to the housing;

a base for the light; and the base and the anchor effectively forming a clip for securing the light to a support, such that the material for the support is locatable between the base and the anchor, and thereby the light is secured to the support for the light.

14. A light as claimed in claim 13, wherein the bead is hingedly movable relative to the housing, and wherein the switch is operable to turn the light source on when the head is moved from the housing.

15. A portable light for mounting on a support comprising:

an anchor to be secured with a support;

a housing portion mounted to the anchor, the housing portion including a head for a light source;

a switch for the light source, the switch being operable by movement of the head for the light source relative to the housing; and a base cooperating with the anchor, the light source being mounted relative to the anchor on a position opposite to the base.

* * * * *